US007124519B2

(12) United States Patent
Issler

(10) Patent No.: US 7,124,519 B2
(45) Date of Patent: Oct. 24, 2006

(54) SHOE SOLE HAVING IMPROVED FLEXIBILITY AND METHOD FOR MAKING THE SAME

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 143 days.

(21) Appl. No.: 10/757,097

(22) Filed: Jan. 14, 2004

(65) Prior Publication Data

US 2005/0150134 A1 Jul. 14, 2005

(51) Int. Cl.
*A43B 13/16* (2006.01)

(52) U.S. Cl. ..... 36/31; 36/102; 36/103

(58) Field of Classification Search ..... 36/31, 36/102, 103, 59 R, 59 C
See application file for complete search history.

(56) References Cited

U.S. PATENT DOCUMENTS

| | | | | |
|---|---|---|---|---|
| 2,931,110 | A | 4/1960 | Pietrocola | |
| 3,165,841 | A | 1/1965 | Rollman | |
| 4,020,569 | A | 5/1977 | Fukuoka | |
| 4,255,874 | A * | 3/1981 | Sironi | 36/32 R |
| 4,309,376 | A * | 1/1982 | Ueno et al. | 264/241 |
| 4,348,003 | A | 9/1982 | Beneteau | |
| 4,564,966 | A * | 1/1986 | Chen | 12/146 B |
| 4,658,516 | A | 4/1987 | Beck | |
| 4,837,949 | A * | 6/1989 | Dufour | 36/127 |
| 4,899,467 | A | 2/1990 | Mackey | |
| 5,024,007 | A * | 6/1991 | DuFour | 36/127 |
| 5,025,573 | A | 6/1991 | Giese et al. | |
| 5,396,675 | A | 3/1995 | Vincent et al. | |
| 5,843,268 | A * | 12/1998 | Lyden et al. | 156/324.4 |
| 5,862,614 | A * | 1/1999 | Koh | 36/31 |
| 6,061,929 | A * | 5/2000 | Ritter | 36/107 |
| 6,237,249 | B1 * | 5/2001 | Aguerre | 36/11.5 |
| 6,571,491 | B1 | 6/2003 | Safdeye et al. | |
| 6,701,643 | B1 * | 3/2004 | Geer et al. | 36/97 |
| 6,910,287 | B1 * | 6/2005 | Truelsen | 36/30 R |
| 2002/0116843 | A1 * | 8/2002 | Harrison | 36/84 |
| 2003/0046832 | A1 * | 3/2003 | Knoerr et al. | 36/30 R |
| 2003/0056397 | A1 | 3/2003 | Hsiao | |

FOREIGN PATENT DOCUMENTS

| | | | |
|---|---|---|---|
| GB | 2092431 | * | 1/1981 |

* cited by examiner

*Primary Examiner*—Marie Patterson
(74) *Attorney, Agent, or Firm*—St. Onge Steward Johnston & Reens LLC

(57) ABSTRACT

The invention relates to a sole and method for making the sole having a first material and a second material. The first material includes a plurality of extensions and the second material includes a plurality of sections, where each section is spaced apart from an adjacent section by at least one extension being placed between each section and each adjacent section.

4 Claims, 3 Drawing Sheets

SHOE SOLE HAVING IMPROVED FLEXIBILITY AND METHOD FOR MAKING THE SAME

FIELD OF THE INVENTION

The invention relates to a method and apparatus for providing a shoe sole with improved flexibility.

BACKGROUND OF THE INVENTION

Historically, most shoe soles typically have a homogenous hardness and are often made of a material with uniform properties throughout the sole. Soles that may be made of a rigid material may provide protection and support to a user's foot. However, a sole made of a rigid material may be uncomfortable in the areas of the sole that flex, such as the toe area, because the rigid sole may inhibit flexing.

On the other hand, a sole made of a soft material may provide comfort to the user's foot in addition to providing improved flexibility in the areas of the sole that are flexed. However, a sole made of a soft material may not provide sufficient support or protection to a user, which may lead to injuries or fatigue. Moreover, a soft material may not provide sufficient structural integrity to hold a predetermined shape over time, which in turn may lead to discomfort.

To alleviate the above problem, soles made of varying hardnesses may have been developed to provide both flexibility and support.

U.S. Publication No2003/0056397 to Hsiao appears to relate to a sole having a hard portion and a soft portion, where the hard and soft portions represent different hardnesses of the sole and where the hard portion seems to gradually change over to the soft portion and vice versa. The sole seems to eliminate a definite border, or separation, between the hard and soft portions.

U.S. Pat. No. 2,931,110 to Pietrocola appears to relate to a sole having two different materials, each being of a different hardness. A rigid material may be poured into a mold to form a majority of the sole, the rigid material may be a single unit having a plurality of holes. When cured, the rigid material is typically placed in a second mold where soft material may be poured into, and left to solidify within, the plurality of holes.

U.S. Pat. Nos. 4,899,467 and 4,658,516 to Mackey and Beck seem to relate to soles similar to the Pietrocola patent, where a majority of the sole is typically of a rigid material and where a soft material is normally placed in a selected area, such as the ball of the foot.

U.S. Pat. Nos. 5,025,573 and 4,348,003 to Giese and Beneteau seem to relate to soles having at least one layer of rigid material being fixed to at least one layer of soft material.

U.S. Pat. Nos. 4,020,569 and 6,571,491 to Fukuoka and Safdeye seem to relate to compounds for making a shoe sole, where the compounds are typically mixtures of rigid and soft materials.

U.S. Pat. No. 3,165,841 to Rollman seems to relate to a sole having a soft material making up a majority of the sole and a rigid material often located under a steel toe. Because the sole usually includes soft material over a majority of the sole, Rollman may lack sufficient support or structural integrity.

Although Pietrocola, Giese, Beneteau, Mackey, and Beck seek to provide soles with improved flexibility and adequate support for the shoes, the flexibility appears to be limited because the soles are substantially made of a rigid material. Pietrocola, Beck, and Mackey seem to show soles made of rigid materials having apertures in selected areas of the rigid materials and where soft materials are placed in the apertures. Giese and Beneteau seem to show soles having rigid materials substantially extend over the entire sole and where soft materials are attached to the rigid materials at particular locations. Although all of these references strive to improve flexibility over traditional shoes, the flexibility seems to be limited. Moreover, it appears that improving rigidity is at the detriment of flexibility, and vice versa.

What is desired, therefore, is a sole that overcomes the limited flexibility or limited rigidity problems associated with the prior art. What is also desired is a sole having improved flexibility without sacrificing support or structural integrity. A further desire is a sole having improved rigidity without negatively affecting flexibility.

SUMMARY OF THE INVENTION

Accordingly, it is an object of the invention to provide a sole that improves flexibility by having pliable materials placed in selected areas between harder, stronger materials along a length of the sole so that the harder, stronger materials are separated from one another.

Another object of the invention is to concentrate the pliable materials in selected areas of the sole.

A further object is to provide a sole that permits increased flexibility without loss of rigidity and a sole that permits increased rigidity without loss of flexibility.

Yet another object is to provide a sole having pliable materials adequately secured to rigid materials.

These and other objects of the invention are achieved by a sole having a first material and a second material. The first material includes a plurality of extensions and the second material includes a plurality of sections, where each section is spaced apart from an adjacent section by at least one extension being placed between each section and each adjacent section.

In some embodiments, the modulus of elasticity of the first material has a higher modulus of elasticity than the second material. In other embodiments, the hardness of the first material is lower than the hardness of the second material. Still in further embodiments, the modulus of elasticity and hardness for the first and second materials are the same.

The sole may include a top surface and a bottom surface, where the first material extends from the top surface to the bottom surface. In addition to or instead of extending from the top surface to the bottom surface, the first material may also extend from the bottom surface to a location between the top and bottom surfaces. Likewise, in addition to or instead of extending from the top surface to the bottom surface, the first material may extend from the top surface to a location between said top and bottom surfaces.

In another embodiment, the sole includes a second material having a plurality of sections, where each section is discretely separated from an adjacent section.

In another aspect of the invention, a method for providing a sole includes the steps of molding a first material to provide a plurality of extensions, molding a second material to provide a plurality of sections, and spacing each section apart from an adjacent section by at least one extension.

In further embodiments, the method includes providing a top surface and a bottom surface of the sole. In some of these embodiments, the method extends the first material from the top surface to a location between the top and bottom surfaces of the sole. In other embodiments, the method may extend the first material from the bottom surface to a location between the top and bottom surfaces of the sole. In still other embodiments, the method extends the first material from the top surface to the bottom surface of the sole.

DETAILED DESCRIPTION OF THE DRAWINGS

Figure 1:
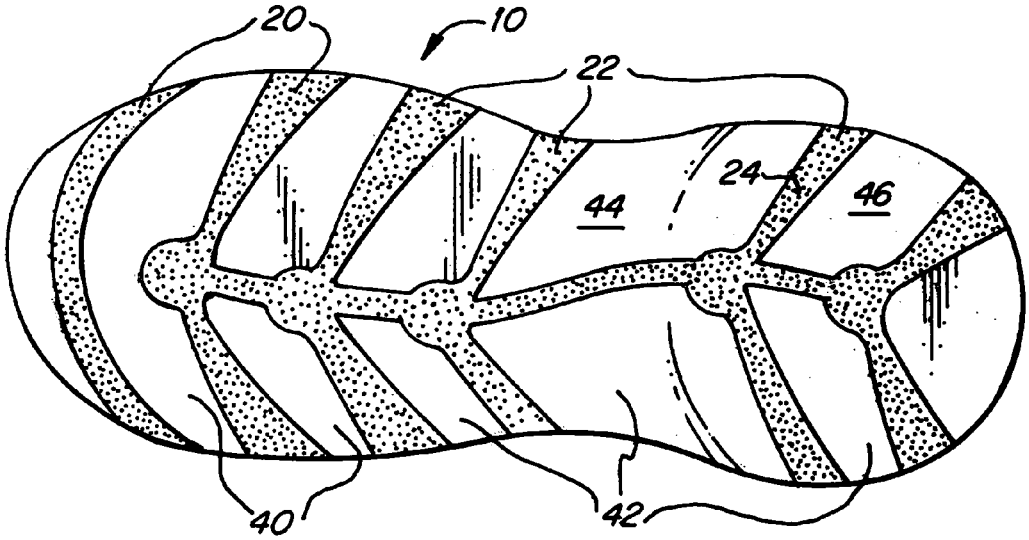
FIG. 1 depicts a bottom view of the sole in accordance with the invention.

FIG. 1 shows a bottom view of sole 10 in accordance with the invention. Sole 10 includes first material 20 and second material 40. As shown, first material 20 includes a plurality 22 of extensions and second material 40 includes a plurality 42 of sections, where each section 44 is separated from an adjacent section 46 by at least one extension 24. Hence, no two sections are in contact with one another.

Because first material 20 has a higher modulus of elasticity than second material 40, sole 10 provides more flexibility to a shoe in areas of sole 10 where first material 20 is located. Increasing the amount of first material 20 improves flexibility and increasing the amount of second material 40 improves support and protection to the user. In traditional shoes, improving flexibility tends to reduce the ability of sole 10 to support and protect a user wearing a shoe, and vice versa.

Sole 10 overcomes this disadvantage by allowing both flexibility and rigidity to be increased without either being negatively affected because each section 44 of rigid material is separated from an adjacent section 46 of rigid material. In this fashion, the rigidity of section 44 does not affect the movement, such as bending or flexing, of adjacent section 46 relative to section 44. Sole 10 separates section 44 from adjacent section 46 by placing at least one extension 24 between each section 44 and adjacent section 46 of the plurality 42 of sections, whereby each section 44 is discretely separated from adjacent section 46.

In this manner, first material 20 may be placed in areas of sole 10 where flexing is desired and second material 40 may be placed in areas of sole 10 where support or protection is desired. For example, first material 20 may be concentrated in areas of sole believed to bend due to walking, such as the ball of the foot or toe area, and second material 40 may be concentrated in the heel or arch of sole 10.

In addition, as shown in FIG. 1, sole 10 may have more rigid material (second material 40), thereby providing more protection and structural integrity, than conventional soles yet have improved flexibility over the conventional shoes because first material 20 separates each section 44 from an adjacent section 46, which allows section 44 to bend or flex relative to section 46 in a manner not traditionally available or possible, especially with conventional shoes having a majority of the sole made of rigid materials.

Figure 2:
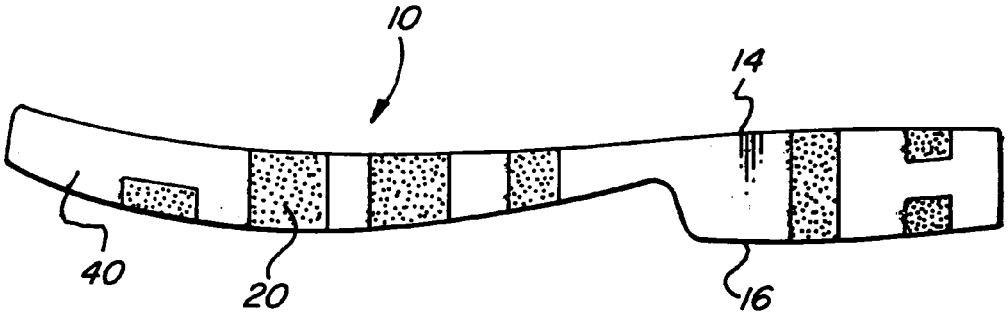
FIG. 2 depicts a side view of the sole in accordance with the invention.

Referring to FIG. 2, first material 20, or the pliable material, need not, although may, extend through the entire thickness of sole 10. In some embodiments, first material 20 extends part of the way through sole 10. Depending upon aesthetic appeal and where flexing is desired, first material 20 may extend from top surface 14 or bottom surface 16 to a location between top surface 14 and bottom surface 16. Partially extending first material 20 through sole 10 may be desired to control costs, flexibility, or reduce manufacturing costs. Moroever, sole 10 may have any combination of first material 20 extending completely through sole 10 from top surface 14 to bottom surface 16, first material 20 extending from top surface 14 partially through sole 10, and/or first material 20 extending from bottom surface 16 partially through sole 10.

It is also understood first material 20 may be placed in selected areas of sole 10 and need not be symmetric about any axis of sole 10. The attachment of first material 20 to second material 40 includes all known or novel manners for attachment, such as adhesives, fasteners, ultrasonic welding, chemical bonding, and the like. The manner for attachment of first and second materials 20 and 40 should not be a limitation of the invention.

In the embodiment shown in FIG. 1, first material 20 has a modulus of elasticity higher than that of second material 40. In other embodiments, first material 20 has a hardness lower than that of second material 40.

However, in further embodiments, the modulus of elasticity and hardness of both first and second materials, 20 and 40, are the same. In these embodiments, it is sufficiently flexible and rigid to have section 44 and adjacent section 46 separated from one another, thereby allowing flexing and bending relative to one another. Hence, first material 20 need not have different properties for the invention to operate.

Figure 4:
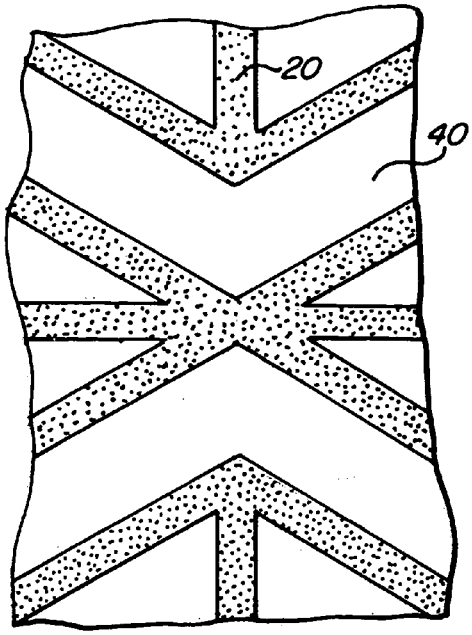
FIGS. 4–6 depict further embodiments of the sole shown in FIG. 1.
Figure 5:
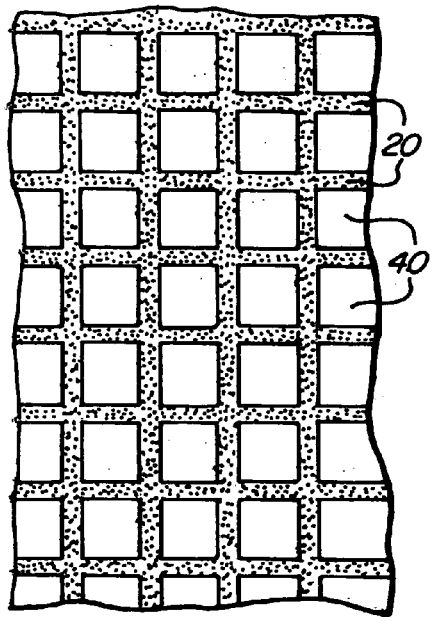
Figure 6:
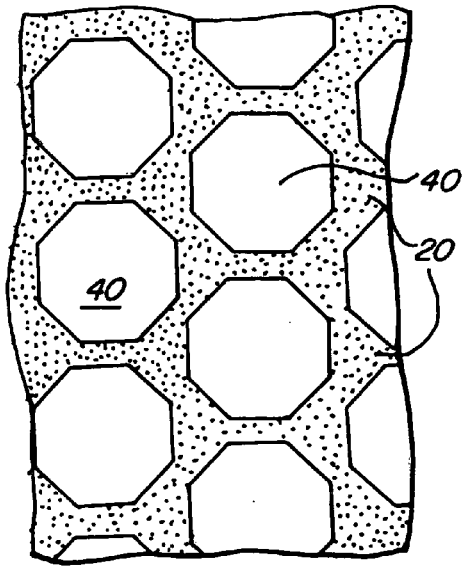

In further embodiments, shown in FIGS. 4–6, various arrangements of first material 20 and second material 40 are shown for providing varying flexibility. It is understood that the invention should not be limited to these designs because any variation or placement of first material 20 and second material 40 are envisioned provided each section 44 of second material 40 is separated from adjacent material 46 by at least one extension 44.

Figure 3:
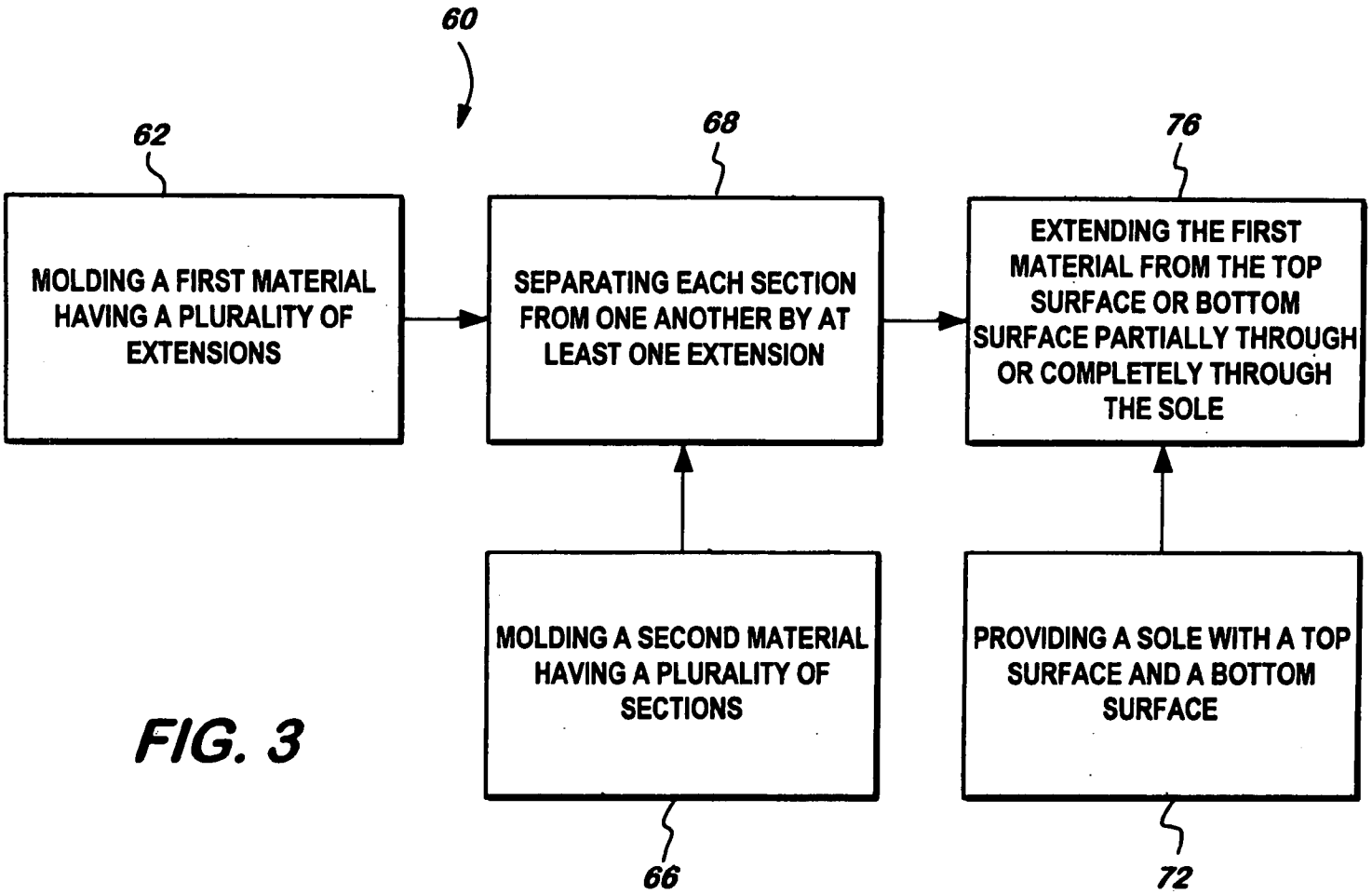
FIG. 3 depicts a method for providing the sole in accordance with the invention.

FIG. 3 depicts method 60 for providing sole 10 in accordance with the invention. Method 60 includes molding 62 a first material having a plurality of extensions and molding 66 a second material having a plurality of sections. Method 60 further includes separating 68, or spacing, each section from an adjacent section by placing at least one extension in between each section from each adjacent section.

In some embodiments, method 60 provides 72 a sole with a top surface and a bottom surface. In these embodiments, method 60 may extend 76 the first material from the top surface partially through the sole to a location between the top and bottom surfaces. Similarly, method 60 may extend 76 the first material from the bottom surface partially through the sole to a location between the top and bottom surfaces. In other embodiments, method 60 extends 76 the first material completely through the sole from the top surface to the bottom surface.

It is envisioned that the method for making the sole includes injecting the first, pliable material into a mold and, when solidified or substantially solidified, placing the first material in a second mold. There, a second, rigid material in liquid form is poured over the first material. Then both first and second materials are solidified completely. The result is a sole formed of a single unit where the first, pliable material acts as a vertebrae for the sole.

Another benefit sole 10 provides is that sole 10 reduces the concentration of weak points over traditional soles that have soft materials bonded to rigid materials. Flexing the sole while walking stresses the areas of contact between dissimilar materials, such as soft and hard materials. Having fewer contact points lessens the quantity of weak points but increases the stress, or concentration of stress, at the remaining contact points between soft and hard materials. Plurality 22 of extensions and plurality 42 of sections spread the stresses from walking over the entire sole because, in some embodiments, plurality 22 of extensions and plurality 42 of sections extend all over, or substantially over, sole 10.

Additionally, in some embodiments, particular placement of second material 40 controls how or where sole 10 is flexed, which may affect how a user walks or flexes his/her foot. In these embodiments, sole 10 acts as an orthodic. A forepart of sole 10 shown in FIG. 1 illustrates how the toe part may be controllably flexed in a heel to toe direction. The forepart of sole 10 may have difficulty flexing in a lateral direction because each sections 44 in the forepart extends laterally and continuously across sole 10, which may inhibit flexing in the lateral direction. Hence, in these embodiments, the forepart of sole 10 aids the user while walking.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A sole, comprising:

a first material having a main support extending in a generally longitudinal direction and a plurality of extensions extending laterally from said main body;

a second material having a plurality of sections;

each section being spaced apart from an adjacent section by at least one extension being placed between said each section and said adjacent section;

the sole further comprises a top surface and a bottom surface;

said first material extends from said top surface to said bottom surface, said first material extends from a bottom surface to a location between said top and bottom surfaces, and said first material extends from a top surface to a location between said top and bottom surfaces in various localized areas of the sole;

said each section being encompassed by said first material; and wherein said first material has a modulus of elasticity higher than said second material.

2. The sole according to claim 1, wherein said first material has a hardness lower than second material.

3. The sole according to claim 1, wherein said each section is discretely separated from said adjacent section.

4. A method for providing a sole, comprising the steps of:

molding a first material to provide a main support and a plurality of extensions;

extending the main support in a generally longitudinal direction;

extending the plurality of extensions laterally from the main support;

molding a second material to provide a plurality of sections;

spacing each section apart from an adjacent section by at least one extension;

providing a top surface and a bottom surface of the sole;

extending the first material from the top surface to a location between the top and bottom surfaces of the sole;

extending the first material from the bottom surface to a location between the top and bottom surfaces of the sole; and extending the first material from the top surface to the bottom surface of the sole.

* * * * *